US009334876B2

(12) United States Patent
Dickinson et al.

(10) Patent No.: US 9,334,876 B2
(45) Date of Patent: May 10, 2016

(54) PUMP CASING AND RELATED APPARATUS AND METHODS

(75) Inventors: Randall D. Dickinson, Kennebunk, ME (US); Nathan Norman Lang, Rochester, NH (US); Don Enos, Dover, NH (US)

(73) Assignee: Thermo Neslab Inc., Newington, NH (US)

( * ) Notice: Subject to any disclaimer, the term of this patent is extended or adjusted under 35 U.S.C. 154(b) by 924 days.

(21) Appl. No.: 13/289,235

(22) Filed: Nov. 4, 2011

(65) Prior Publication Data

US 2012/0263608 A1 Oct. 18, 2012

Related U.S. Application Data

(60) Provisional application No. 61/474,542, filed on Apr. 12, 2011.

(51) Int. Cl.
*F04D 29/42* (2006.01)
*F04D 29/44* (2006.01)
*F04D 29/62* (2006.01)

(52) U.S. Cl.
CPC ..... *F04D 29/4266* (2013.01); *F04D 29/426* (2013.01); *F04D 29/628* (2013.01)

(58) Field of Classification Search
CPC .. F04D 29/4266; F04D 29/426; F04D 29/628
USPC ..... 415/200, 203, 204, 206, 212.1, 213.1, 415/214.1, 215.1, 208.3, 211.1, 93, 99, 415/101; 416/423.14, 424.1; 392/441, 444, 392/447; 417/423.14, 424.1
See application file for complete search history.

(56) References Cited

U.S. PATENT DOCUMENTS 929,230 A * 7/1909 Landrum et al. ..... 415/211.1
2,117,011 A 5/1938 Pratt
2,302,095 A * 11/1942 Bartch ..... 415/98
2,420,401 A * 5/1947 Prokofieff ..... 415/206
2,903,182 A * 9/1959 Downs ..... 415/93

(Continued)

FOREIGN PATENT DOCUMENTS

DE 10145353 A1 * 4/2003
DE 10 2007 012 661 A1 9/2008

(Continued)

OTHER PUBLICATIONS

Machine translation of DE 10145353, Apr. 3, 2003.*

(Continued)

*Primary Examiner* — Christopher Verdier
(74) *Attorney, Agent, or Firm* — Wood, Herron & Evans, LLP

(57) ABSTRACT

A pump casing has a metallic band that defines a sidewall of the pump casing and having at least one tab projecting from a surface thereof or at least one opening. The pump casing also has first and second plates disposed opposite one another, with the metallic band being disposed there between, and with the first and second plates and the metallic band jointly defining a chamber of the pump casing. At least one of the first or second plates includes at least one tab or at least one opening respectively cooperating with the at least one opening or the at least one tab of the metallic band so as to retain a formed shape of the metallic band in the pump. The at least one opening may, for example, be a slot in the at least one of the first or second plates.

13 Claims, 6 Drawing Sheets

(56) References Cited

U.S. PATENT DOCUMENTS

| | | | | | |
|---|---|---|---|---|---|
| 2,969,741 | A | | 1/1961 | Wright et al. | |
| 3,000,321 | A | | 9/1961 | Parker | |
| 3,070,026 | A | | 12/1962 | Lung | |
| 3,116,696 | A | | 1/1964 | Deters | |
| 3,361,068 | A | | 1/1968 | Wochner | |
| 3,758,236 | A | * | 9/1973 | Zimmerman | 417/424.1 |
| 4,787,818 | A | * | 11/1988 | Bales et al. | 415/206 |
| 5,040,946 | A | | 8/1991 | Caoduro | |
| 5,076,762 | A | * | 12/1991 | Lykes et al. | 417/424.1 |
| 5,158,432 | A | * | 10/1992 | Cox | 415/214.1 |
| 5,228,831 | A | | 7/1993 | Becker | |
| 5,232,341 | A | | 8/1993 | Shier et al. | |
| 5,234,317 | A | | 8/1993 | Kajiwara et al. | |
| 5,256,033 | A | | 10/1993 | Kajiwara | |
| 5,310,310 | A | | 5/1994 | Nakatsukasa et al. | |
| 5,318,403 | A | | 6/1994 | Kajiwara et al. | |
| 5,358,380 | A | | 10/1994 | Arakawa | |
| 5,369,972 | A | | 12/1994 | Kajiwara et al. | |
| 5,385,444 | A | | 1/1995 | Kobayashi et al. | |
| 5,492,456 | A | | 2/1996 | Knight et al. | |
| 5,888,053 | A | | 3/1999 | Kobayashi et al. | |
| 6,082,960 | A | | 7/2000 | Fandrey et al. | |
| 6,267,555 | B1 | | 7/2001 | Chien et al. | |
| 6,537,024 | B2 | | 3/2003 | Chien et al. | |
| 6,979,174 | B2 | | 12/2005 | Watson et al. | |
| 7,632,065 | B2 | | 12/2009 | Kawabata et al. | |
| 7,648,337 | B2 | | 1/2010 | Kuroiwa et al. | |
| 8,469,678 | B2 | * | 6/2013 | Preston | 417/424.1 |
| 2002/0148273 | A1 | | 10/2002 | McKinney et al. | |
| 2007/0077158 | A1 | | 4/2007 | Pelmulder et al. | |
| 2008/0193284 | A1 | * | 8/2008 | Hoeffken | 415/203 |
| 2010/0008771 | A1 | | 1/2010 | Vedsted | |
| 2010/0040456 | A1 | * | 2/2010 | Hwang et al. | 415/206 |
| 2011/0052384 | A1 | | 3/2011 | Shi et al. | |

FOREIGN PATENT DOCUMENTS

| | | | |
|---|---|---|---|
| EP | 0 494 675 | A2 | 7/1992 |
| EP | 0 536 825 | A1 | 4/1993 |

OTHER PUBLICATIONS

European Patent Office, English Machine Translation of German Application No. DE10145353, 7 pages, Apr. 3, 2003.

* cited by examiner

PUMP CASING AND RELATED APPARATUS AND METHODS

The present application claims the filing benefit of U.S. Provisional Application Ser. No. 61/474,542, filed Apr. 12, 2011, the disclosure of which is incorporated herein by reference in its entirety.

FIELD OF THE INVENTION

The present invention is generally related to pump casings and, more particularly, to pump casings forming part of immersion circulators and related apparatus.

BACKGROUND OF THE INVENTION

Circulating baths are used in laboratory settings for circulating a fluid, such as water, between a vessel containing the fluid, and an application. The circulator moves the working fluid past heating and/or cooling elements of the bath so as to achieve a generally uniform desired fluid temperature, and circulates it to/from the application. Conventional applications, for example, may include a heating jacket intended to maintain a sample-holding container or some other apparatus at a desired temperature To this end, circulating baths are built with pumps that are immersed in the fluid held in the vessel. Known pumps, such as centrifugal pumps, are used for this purpose and may include seals, such as elastomeric seals, exposed to the fluid. A problem with this type of pump is that exposure to relatively hot fluids limits the life span of the seals, which requires their replacement. To address these problems, pumps have been provided that are at least mostly if not entirely made of metal. Pumps of this type may include metallic components that are stamped or cast, which makes manufacturing thereof a rather complex and/or expensive proposition It would be desirable, therefore, to provide a pump casing that addresses the problems described above while being simple and inexpensive to manufacture.

SUMMARY OF THE INVENTION

The present invention overcomes the foregoing and other shortcomings and drawbacks of metallic pumps heretofore known for use in forming part of immersion circulators and related apparatus. While the invention will be described in connection with certain embodiments, it will be understood that the invention is not limited to these embodiments. On the contrary, the invention includes all alternatives, modifications and equivalents as may be included within the spirit and scope of the present invention.

In one embodiment a pump casing for a pump, such as a centrifugal pump, is provided. The pump casing has a metallic band that defines a sidewall of the pump casing and has at least one tab projecting from a surface thereof or at least one opening. The pump casing also has first and second plates disposed opposite one another, with the first and second plates and the metallic band jointly defining a chamber of the pump casing. At least one of the first or second plates includes at least one tab or at least one opening respectively cooperating with the at least one opening or the at least one tab of the metallic band so as to retain a formed shape of the metallic band defining the pump casing.

The at least one opening may, for example, be a slot in the at least one of the first or second plates. The metallic band may be formed from stainless steel. Additionally or alternatively, the metallic band may have a length dimension and a pair of opposed longitudinal ends, with the longitudinal ends being in a contacting relationship with and overlapping one another. In another specific embodiment, the metallic band includes a plurality of the tabs and the first and second plates both include respective pluralities of the openings, each of which respectively receives one of the tabs of the metallic band therein.

In another embodiment, a pump is provided that may form part of an immersion circulator. The pump includes a pump casing that has a metallic band defining a sidewall of the pump casing and having at least one tab projecting from a surface thereof or at least one opening. The pump casing also includes first and second plates that are disposed opposite one another, with the metallic band being disposed there between, and wherein the first and second plates and the metallic band jointly define a first chamber of the pump. At least one of the first or second plates includes at least one tab or at least one opening respectively cooperating with the at least one of the opening or tab of the metallic band so as to retain a formed shape of the metallic band defining the pump casing. The pump also includes a first impeller that is disposed within the first chamber.

The pump may also include a second metallic band that partially defines a second chamber of the pump, as well as a second impeller that is located within the second chamber. Additionally, the pump may include a first conduit that is in fluid communication with the first chamber for directing fluid between the first chamber and a location away from the pump, and a second conduit that is in fluid communication with the second chamber for transporting fluid between the second chamber and the location away from the pump.

In a specific embodiment, one of the first or second impellers is configured to rotate so as to draw fluid into one of the first or second chambers, and the other of the first or second impellers is configured to rotate so as to expel fluid away from the other of the first or second chambers. The first and second chambers may be spaced from one another. The pump, in a specific embodiment, includes a third casing that defines a suction chamber of the pump, and which is disposed between the first and second metallic bands.

In another embodiment, an immersion circulator is provided that includes a pump, such as the pump described above, and also having a control housing that includes a controller and a shaft. The shaft, in that embodiment, is operatively coupled to the controller, and is configured to drive the first impeller, with the controller being configured to control rotation of the shaft. In another embodiment, a circulating bath is provided that includes an immersion circulator such as the immersion circulator described above, as well as a fluid container or vessel that supports the immersion calculator.

In yet another embodiment, a method is provided for manufacturing a pump casing with a metallic band that has at least one tab projecting from a surface thereof or at least one opening. The pump casing has first and second plates disposed opposite one another, with the metallic band being disposed there between, and with at least one of the first or second plates including at least one tab or at least one opening. The method includes bending the metallic band so as to define a sidewall to the pump casing, and inserting the at least one tab of the metallic band or the at least one tab of the first or second plates into the at least one opening of the other of the metallic band or the first or second plates. Insertion of the at least one tab into the at least one opening is effective to retain the bent shape of the metallic band defining the pump casing. The method may include inserting a plurality of tabs of the metallic band into respective pluralities of slots of the first and second plates, to thereby retain the bent shape of the metallic band. Additionally or alternatively, the method may include placing the longitudinal ends of the metallic band in contacting and overlapping relationship with one another.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
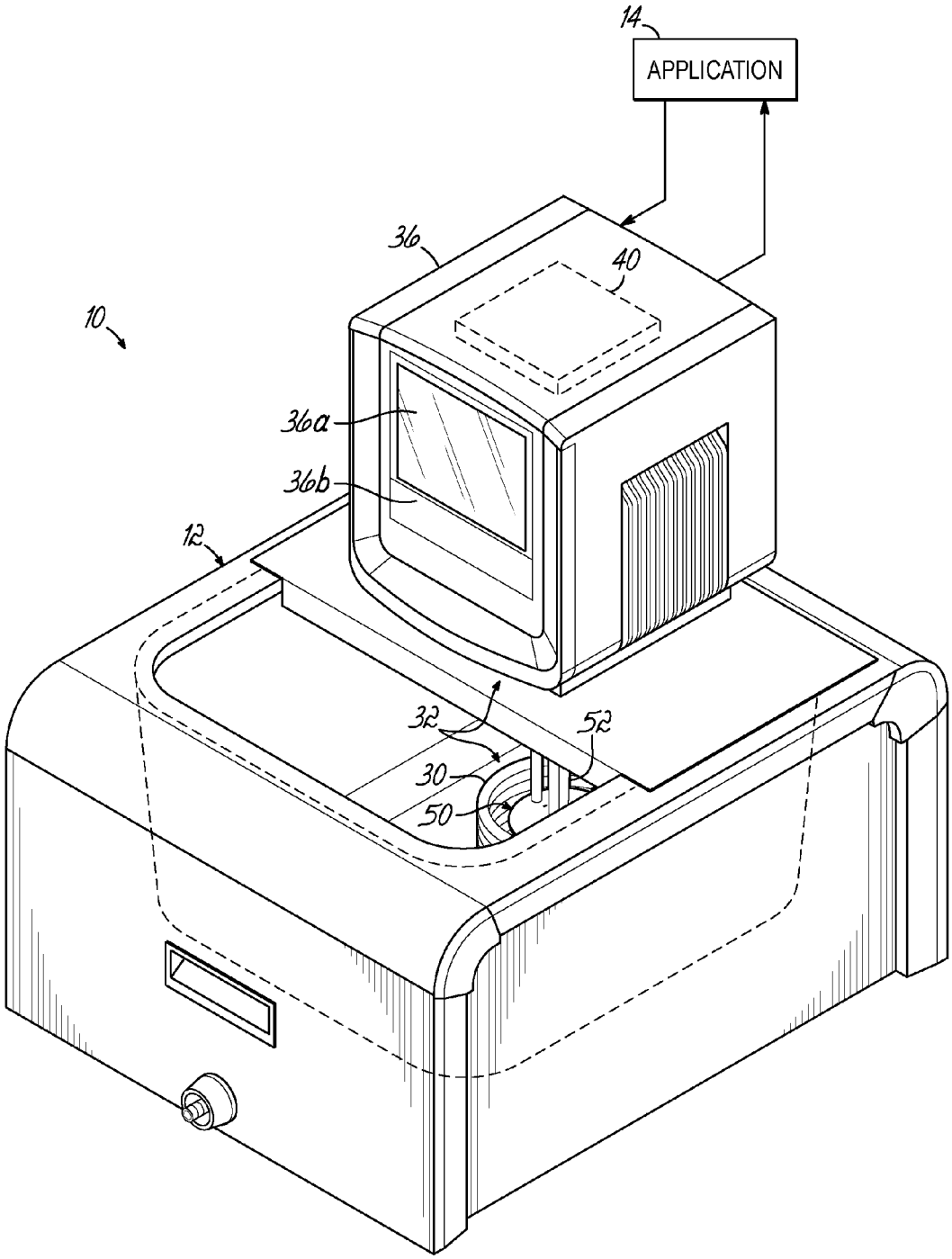
FIG. 1 is a perspective view of a circulating bath in accordance with one embodiment of the invention.
Figure 2:
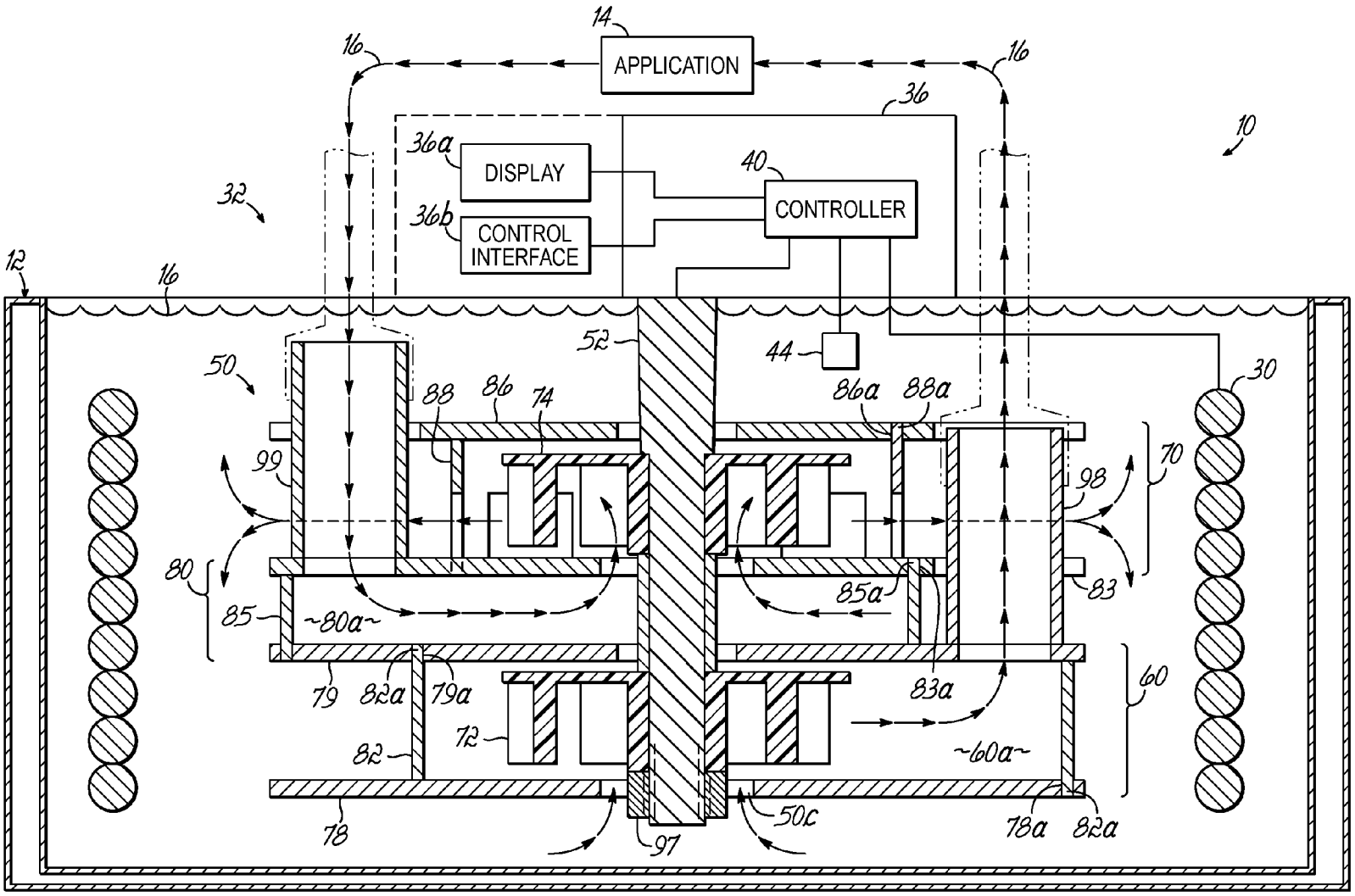
FIG. 2 is a diagrammatic cross-sectional view of the circulating bath of FIG. 1.

With respect to the figures, and particularly to FIGS. 1 and 2, a circulating bath 10 is illustrated for circulating a fluid between a container or vessel 12 and an application 14 (diagrammatically illustrated), such as a heating jacket or some other application. In operation, a fluid 16 (e.g., water) contained in the vessel 12 is drawn out of the vessel 12 and fed to the application 14, and received by the vessel 12 from the application 14 in a closed-loop configuration. In certain applications, the fluid 16 is heated to a predetermined temperature in the vessel 12 before it is fed to the application 14. To this end, the fluid 16 in the vessel 12 is heated by a heater, such as a heating coil 30, forming part of an immersion circulator 32 supported by the vessel 12, and which is at least partially immersed in the fluid 16.

The immersion circulator 32 also includes a main or control housing 36 that includes a controller 40 and which controls the actuation and heat emitted by the heater 30. In operation, the user may use a display 36*a* and control interface 36*b* of the control housing 36 to set a desired temperature for the fluid 16. In addition, the immersion circulator 32 also includes a temperature sensor 44, such as a thermocouple, that is immersed in the fluid 16 and generates a signal to the controller 40 associated with the sensed temperature thereof. The controller 40, in response, controls the emission of heat by the heater 30 until the desired temperature of the fluid 16 is reached and to maintain that desired temperature.

Figure 3:
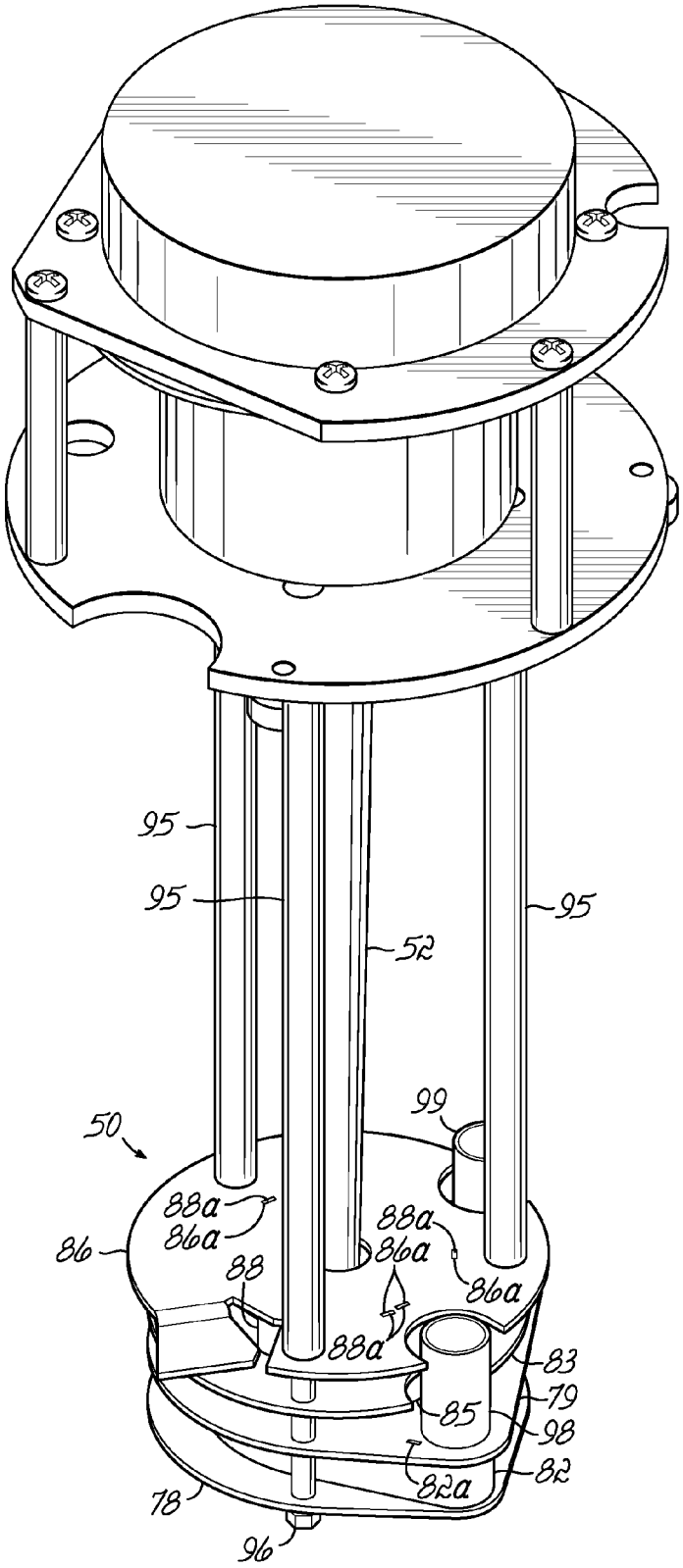
FIG. 3 is a perspective view of a portion of an immersion circulator of the circulating bath of FIGS. 1 and 2.
Figure 4:
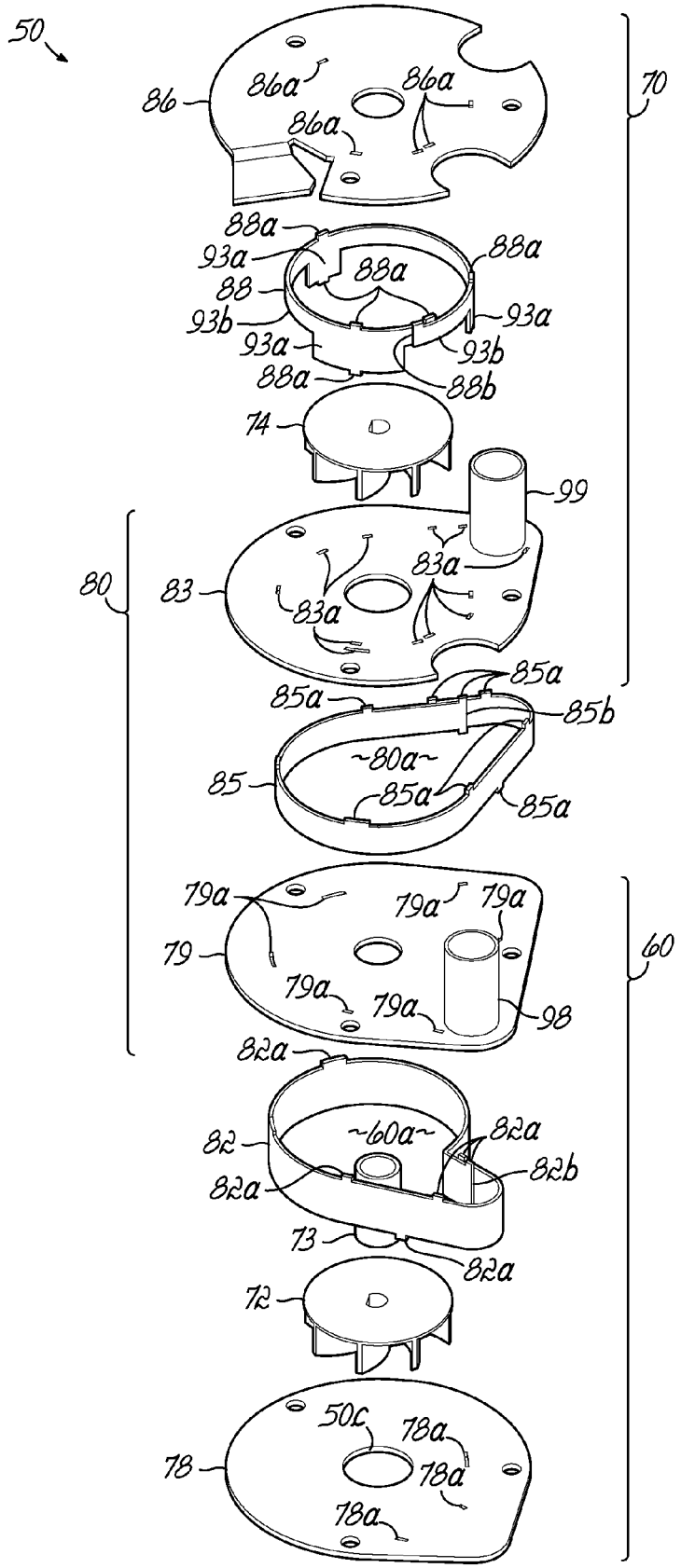
FIG. 4 is a disassembled view of a pump of the immersion circulator of FIG. 3.

With continued reference to FIGS. 1 and 2, and referring further to FIGS. 3 and 4, the immersion circulator 32 also includes a pump 50, such as a centrifugal pump, supported from the control housing 36, and a shaft 52 that is operatively coupled to the controller 40. As explained in further detail below, rotation of the shaft 52 is effective to operate the pump 50 so as to circulate the fluid 16 between the interior of the vessel 12 and the application 14. A power supply (not shown) provides power to the immersion circulator 32. The control housing 36 controls actuation of the shaft 52, as well as the rotational speed of the shaft 32, which may be set and/or displayed through the control interface 36*b* and display 36*a*.

The exemplary pump 50 includes a pair of end pump casings or enclosures 60, 70 and an intermediate casing 80 located between the end casings 60, 70. The end casings 60, 70 have, in their respective interiors, a respective impeller 72, 74 operatively coupled to and driven by the shaft 52. A tubular member 73 (FIG. 4) provides a spacing between the two impellers 72, 74 and is coupled to the shaft 52. Those of ordinary skill in the art will readily appreciate that the specific configuration and construction of the pump 50 is intended to be exemplary rather than limiting, insofar as variations thereof are contemplated.

The end pump casing 60 and the intermediate casing 80 are generally closed casings defining respective volute chambers 60*a*, 80*a* of the pump 50. The end pump casing 60 includes a first, bottom end plate 78 located at the bottom of the pump 50, a second plate 79 disposed opposite the first plate 78, and a metallic band 82 bent (i.e., roll-formed) so as to define a sidewall of the end pump casing 60 and of the pump 50. The intermediate casing 80 includes the second plate 79, a third plate 83 disposed opposite the second plate 79, and a metallic band 85 bent (i.e., roll-formed) so as to define a sidewall of the intermediate pump casing 80 and another sidewall of the pump 50. The end pump casing 70 includes the third plate 83, a fourth, top end plate 86 disposed opposite the third plate 83, and a deflector or guard 88 disposed about the impeller 74. The metallic bands 83, 85 are formed from a suitably chosen metal, such as stainless steel, or some other suitably chosen material. The plates 78, 79, 83, 86 and/or the deflector 88 may also be made from stainless steel or from some other suitably chosen metallic or non-metallic material.

The bent shapes of the metallic bands 82, 85 are retained through engagement of one or more tabs and associated openings (e.g., slots) located at the interface between the metallic bands 82, 85 and one or more of the plates 78, 79, 83, 86 adjacent the metallic bands 82, 85. As used herein, the term "tab" and derivatives thereof refers to projecting elements that may be flat, plate-like structures, or alternatively, and without limitation, in the form of pins. In the illustrated embodiment, and also without limitation, each of the metallic bands 82, 85 has a respective plurality of tabs 82*a*, 85*a* extending from the top and bottom edges of the metallic bands 82, 85. Each of the tabs 82*a*, 85*a* is received within one of a plurality of openings, such as slots 78*a*, 79*a*, 83*a*, 86*a* in the illustrated embodiment, forming part of the plates 78, 79, 83, 86. In alternative embodiments, the openings may take forms other than slots, such as holes or some other type of aperture, and still fall within the scope of the present disclosure.

Figure 4A:
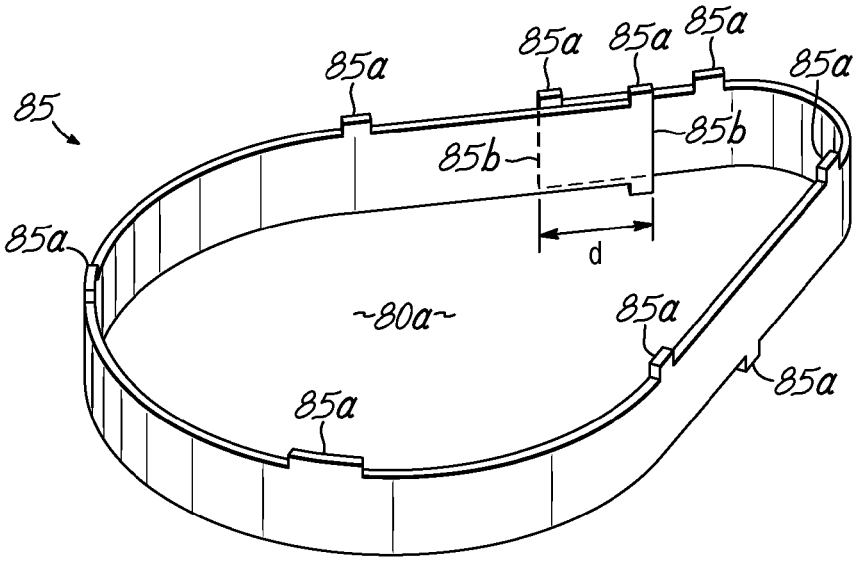
FIG. 4*a* is an enlarged perspective view of a metallic band forming part of the pump of FIG. 4.

An exemplary construction of the pump 50, accordingly, contemplates bending the metallic bands 82, 85 into the desired shape, such as by roll-forming the metallic bands 82, 85, and inserting the tabs 82*a*, 85*a* into respective ones of the slots 78*a*, 79*a*, 83*a*, 86*a*. The engagement of the tabs 82*a*, 85*a* with the slots 78*a*, 79*a*, 83*a*, 86*a* is effective to secure the location of the metallic bands 82, 85 relative to the plates 78, 79, 83, 86 and is also effective to retain the bent shape of the metallic bands 82, 85 defining the respective sidewalls of pump casings 60 and 80. In one aspect of the exemplary formation of the pump casings 60, 80, the bent shape of each of the metallic bands 82, 85 is such that the longitudinal ends 82*b*, 85*b* thereof contact one another and overlap one another by a predetermined distance "d," as best seen in FIG. 4A.

While FIGS. 1-4 and 4A, and the description thereof, refer to the metallic bands 82, 85 having pluralities of tabs 82*a*, 85*a* and the plates 78, 79, 83, 86 having respective pluralities of slots 78*a*, 79*a*, 83*a*, 86*a*, it is contemplated that an alternative embodiment may include tabs projecting from the plates 78, 79, 83, 86 that are received in slots or other types of openings in the metallic bands 82, 85. Likewise, while it is contemplated that the tabs 82*a*, 85*a* may be shaped differently from those shown in the figures and/or even project from surfaces other than the top and bottom edges of the metallic bands 82, 85. In addition, it is contemplated that one or both of the metallic bands 82, 85 may have a combination of tabs and openings (e.g., slots) that are interlocked with corresponding combinations of tabs and openings (e.g., slots) of the plates 78, 79, 83, 86.

With particular reference to FIG. 4, the exemplary deflector 88 defining end pump casing 70 is made of sheet metal, such as stainless steel, that is bent in ways similar to the bending of metallic bands 82, 85. The final, bent shape of the sheet metal is retained in ways also similar to those associated with the retaining of the bent shape of metallic bands 82, 85. More specifically, the deflector 88 may also have one or more tabs 88*a* received within corresponding openings (e.g., slots) in one or both of the third and fourth plates 83, 86 that also form part of casing 70. It is contemplated, however, that the deflector 88 may instead or additionally have one or more openings (e.g., slots) receiving a corresponding number of tabs projecting from one or both of the plates 83, 86.

Deflector 88 has a shape that is different from those of the metallic bands 82, 85. Specifically, while the metallic bands 82, 85 define completely closed respective sidewalls of the casings 60, 80, deflector 88 is a discontinuous structure defining a substantially open sidewall of the casing 70. In that regard, the sidewall defined by deflector 88 has three relatively narrow portions 93*a* extending between the plates 83, 86 that define 3 relative wide openings 93*b*. In operation, the fluid 16 that is accelerated by the impeller 74 within the substantially open chamber defined by casing 70 is directed away from that chamber and forced to flow through one of the openings 93*b*. This forcing of the fluid 16 through the openings 93*b* minimizes the turbulence of the fluid 16 flowing out of the pump 50 and back into the vessel 12.

In another aspect of the exemplary pump 50, the same is supported from housing 36 through a plurality of support rods 95 that extend through respective holes in the plates 78, 79, 83, 86 and are which are secured to the bottom surface of the first bottom end plate 78 through respective fasteners (e.g., bolts) 96. The shaft 52 is secured to a bottom surface of impeller 72 through another fastener (e.g., bolt) 97. Those of ordinary skill in the art will readily appreciate that this support configuration for pump 50 is intended to be illustrative rather than limiting, insofar as other configurations are contemplated, so long as they provide a structural connection between the housing 36 and pump 50 that jointly define an integral unit for immersion circulator 32.

An exemplary operation of the pump 50 includes rotation of the shaft 52 and the resulting rotation of the impellers 72, 74 to which the shaft 52 is coupled. In this embodiment, the impellers 72, 74 rotate in the same direction and their respective orientations are the same i.e., their respective sets of vanes are angled in the same direction. It is contemplated, however, that an alternative configuration of the pump 50 may be such that the vanes of the impellers 72, 74 may be oriented in opposite directions. Accordingly, in the illustrated embodiment, rotation of the impellers 72, 74 in the same direction is effective to draw fluid 16 from the interior of vessel 12 into the volute chamber 60*a* and also effective to expel fluid from within the interior of casing 70 back into the vessel 12.

More specifically, and with particular reference to FIGS. 2 and 4, rotation of the impeller 72 is effective to draw fluid 16 from vessel 12 through an opening 50*c* defined through the first, bottom end plate 78. Fluid 16 thus flows into the interior of pump 50, filling the volute chamber 60*a*. Fluid 16 then flows out of volute chamber 60*a* through an outlet conduit 98 that fluidly communicates the interior of volute chamber 60*a* with the application 14. The treated (e.g., heated) fluid 16 flows to the application 14 and returns to the pump 50 (i.e., from application 14) through an inlet conduit 99 that is in fluid communication with volute suction chamber 80*a*. Rotation of impeller 74 then forces fluid 16 to flow from volute suction chamber 80*a* into the interior of casing 70 with which chamber 80*a* fluidly communicates. Finally, fluid 16 flows from the interior of casing 70, through the openings 93*b* back into the vessel 12, thereby completing the cycle of flow of fluid 16.

Figure 5:
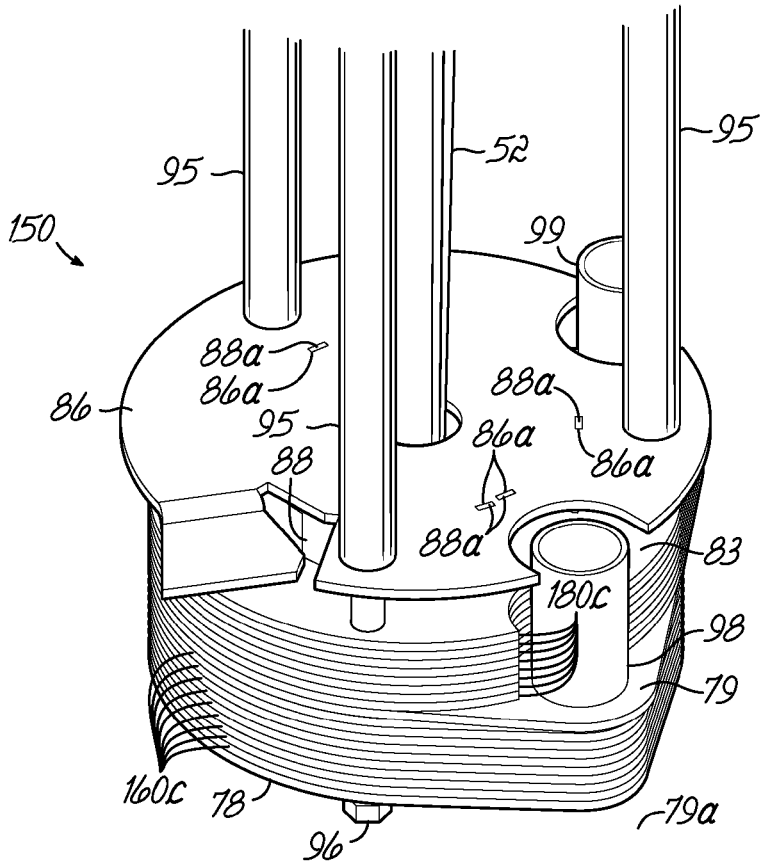
FIG. 5 is a perspective view of a pump of an immersion circulator in accordance with another embodiment of the invention.
Figure 6:
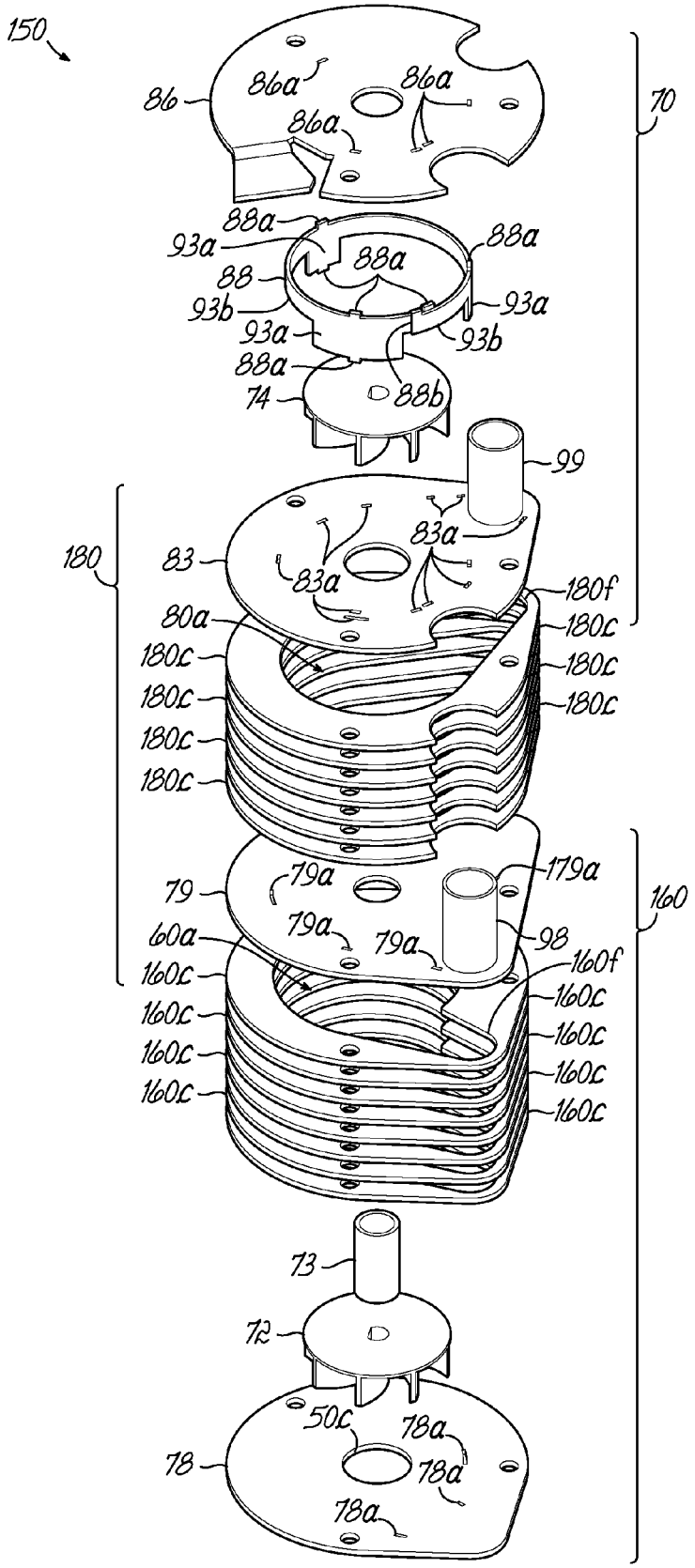
FIG. 6 is a disassembled view of the pump of FIG. 5.

Referring now to FIGS. 5 and 6, another embodiment of a pump 150 is illustrated. For ease of explanation, like reference numerals in FIGS. 5 and 6 refer to similar features in FIGS. 1-4, the description of which may be referred to for an understanding of the features of pump 150 as well. Pump 150 includes an end pump casing 160 defining a volute chamber in its interior and an intermediate casing 180 defining a suction volute chamber in the interior thereof. The casings 160 and 180 are respectively similar, in shape and function, to the casings 60 and 80 of the pump 50 of FIGS. 1-4 and 4A.

Rather than being formed from a bent (i.e., roll-formed) metallic band, each of the casings 160 and 180 is made of a stacked plurality of preformed (e.g., stamped) volute-shaped closed metallic elements 160*c*, 180*c*. In that regard, each of the metallic elements 160*c*, 180*c* is formed so as to include respective holes to receive one of the support rods 95 therethrough, as well as a protruding portion 160*f*, 180*f* providing a respective interface with the inlet conduit 98 and with the outlet conduit 99. When stacked and joined to one another, the metallic elements 160*c*, 180*c* define respective volute chambers in the interior of the pump casings 160, 180, similar in shape and function to the volute chambers 60*a*, 80*a* of the embodiment of FIGS. 1-4 and 4A.

Referring now to both of the embodiments shown in FIGS. 1-6, the unique construction of the pumps in those embodiments, as well as the materials from which they are made, allow exposure of the pumps 50, 150 to high fluid temperatures. More specifically, the pumps 50, 150 are made at least substantially of metal and are free of elastomeric seals (e.g., O-rings), which eliminates the concern for the limited lifespan of immersion circulator pumps that have seals of that type exposed to relative hot running fluids.

While the embodiments of FIGS. 1-6 show respective pumps 50, 150 each having two impellers 72, 74, those of ordinary skill in the art will readily appreciate that the materials and construction disclosed herein are similarly applicable to pumps of different types (e.g., single stage, multistage, push-pull) having any number of impellers. In addition, the materials and construction disclosed herein are also applicable to pumps forming part of other devices different from immersion-type devices, in laboratory-type settings or other industries.

While the present invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicant's general inventive concept.

What is claimed is:

1. A pump forming part of an immersion circulator configured for use in a circulating bath containing a working fluid, said pump comprising:

a plurality of pump casings including:

a first metallic band defining a sidewall of one of said pump casings and having at least one tab projecting from a surface of said metallic band or at least one opening, and first and second plates disposed opposite one another, with said metallic band being disposed there between, and with said first and second plates and said first metallic band jointly defining a first chamber of said pump which is configured to be filled with the working fluid when the pump is immersed in the working fluid, wherein at least one of said first or second plates includes at least one tab or at least one opening respectively cooperating with said at least one opening or said at least one tab of said metallic band so as to retain a formed shape of said metallic band defining said pump casing;

a second metallic band partially defining a second chamber of said pump; and a third metallic band defining a third chamber of said pump with said third chamber being disposed between said first and second chambers and with a bent shape of said third metallic band being retained through engagement of at least one tab and at least one opening at an interface between said third metallic band and said first or second plate;

a first impeller disposed within said first chamber; and a second impeller disposed within said second chamber.

2. The pump of claim 1, wherein said first chamber is a volute chamber.

3. The pump of claim 1, wherein said first metallic band has a length dimension and a pair of opposed longitudinal ends, said longitudinal ends being in a contacting relationship with and overlapping one another.

4. The pump of claim 1, wherein said first metallic band is formed from rolled sheet metal.

5. The pump of claim 4, wherein said first metallic band is formed from stainless steel.

6. The pump of claim 1, further comprising:

a first conduit in fluid communication with said first chamber for directing fluid between said first chamber and a location away from said pump; and a second conduit in fluid communication with said third chamber for directing fluid between said third chamber and the location away from said pump.

7. The pump of claim 6, wherein one of said first or second impellers is configured to rotate so as to draw fluid into said first chamber, and the other of said first or second impellers is configured to rotate so as to expel fluid away from said second and third chambers.

8. The pump of claim 7, wherein the first and second impellers are configured to rotate in the same direction.

9. The pump of claim 1, wherein said third chamber defines a suction chamber of said pump.

10. The pump of claim 1, wherein said second metallic band defines a deflector of said pump, said deflector configured to control the direction of flow of the working fluid flowing from said second chamber.

11. A circulating bath comprising:

the immersion circulator of claim 10; and a fluid container supporting said immersion circulator and configured to contain fluid circulated by said immersion circulator.

12. The pump of claim 1, wherein said pump is free of elastomeric seals exposed to the fluid when said pump is immersed therein and said first impeller is rotating.

13. An immersion circulator comprising:

the pump of claim 1, a control housing having a controller; and a shaft operatively coupled to said controller and configured to drive said first impeller, said controller controlling rotation of said shaft.

* * * * *